United States Patent [19]

Tanaka

[11] 4,069,969

[45] Jan. 24, 1978

[54] AUTOMATIC THREE STAGE CENTRIFUGAL SLUDGE SEPARATOR

[75] Inventor: Yasuhisa Tanaka, Miyoshi, Japan

[73] Assignee: Mitsubishi Kakoki Kaisha, Ltd., Tokyo, Japan

[21] Appl. No.: 727,562

[22] Filed: Sept. 28, 1976

[51] Int. Cl.[2] ..... B04B 11/00

[52] U.S. Cl. ..... 233/20 A

[58] Field of Search ..... 233/20 R, 20 A, 19 R, 233/19 A

[56] References Cited

U.S. PATENT DOCUMENTS

| | | | |
|---|---|---|---|
| 2,578,484 | 12/1951 | Nyrop | 233/20 A |
| 3,460,750 | 8/1969 | Silla | 233/20 R |

FOREIGN PATENT DOCUMENTS

| | | | |
|---|---|---|---|
| 11,307 | 4/1972 | Japan | 233/20 A |
| 1,295,526 | 11/1972 | United Kingdom | 233/20 A |
| 490,501 | 1/1976 | U.S.S.R. | 233/20 A |

*Primary Examiner*—George H. Krizmanich

*Attorney, Agent, or Firm*—Sughrue, Rothwell, Mion, Zinn and Macpeak

[57] ABSTRACT

A centrifugal separator for fuel oil contaminated by water and sludge particles includes an inlet 41, nested separator plates 15, a clean oil outlet 1, a separated water outlet 2, and sludge outlets 48 controlled by a valve cylinder 50 closed by a water pressure chamber 32 and opened by a water pressure chamber 31. When the sludge layer 28 builds up and closes off the water discharge passage 27, the trapped water similarly builds up and overflows into chamber 33 to force piston 36 downwardly. This opens a valve 38, 39 to allow water from chamber 24 to enter chamber 31 and force the cylinder 50 downwardly to open the sludge outlets. The water in chambers 31 and 33 is slowly bled off through vent nozzles, whereby water in chamber 23 enters chamber 32 to raise the cylinder 50 and close the sludge outlets, and enters chamber 34 to raise the piston 36 and close the valve 38, 39.

9 Claims, 5 Drawing Figures

AUTOMATIC THREE STAGE CENTRIFUGAL SLUDGE SEPARATOR

BACKGROUND OF THE INVENTION

This invention relates to a centrifugal separator for a three-phase mixture of sludge, heavy liquid and light liquid, and more specifically to an automatic sludge discharging centrifugal separator including means for detecting the level of sludge accumulated in a rotary structure, and means responsive thereto for causing the structure to periodically discharge the sludge.

In conventional automatic sludge discharging centrifugal separators, high concentrations of sludge are desirably accumulated exactly up to an intended volume level in a rotary structure, and then the sludge is discharged. It is difficult, however, to accurately detect the volume of sludge deposited in the rotary structure. Typically, the sludge discharge is therefore carried out at certain time intervals on a trial and error basis, or after the quantity of sludge deposited has already become excessive. A variety of methods have been proposed in the prior art for detecting the sludge accumulation level. For example, one method utilizes a phenomenon in which a liquid passage is closed by the surface of sludge deposited in the rotary structure approaching the rotation center. See, for instance, Japanese Patent Publication Nos. 24490/1963, 29839/1969 and 25351/1973. Another method utilizes vibration generated in the rotary structure by the increase of the sludge level. See, for instance, Japanese Pat. Publication No. 28837/1969. Still another method detects the sludge level in accordance with the up and down movement of a float due to the specific gravity difference, as in Japanese Pat. Publication No. 43345/1971. A final method detects the sludge level by utilizing the circulation of liquid due to the specific gravity difference, as in Japanese Pat. Publication No. 3401/1973. However, these methods suffer from the following difficulties: (1) since the sludge level detecting means is typically connected through an electrical mechanism to the sludge discharging means, if the centrifugal separator is operated under severe conditions, the electrical mechanism is liable to be damaged, and besides this, the installation cost is expensive; and (2) the conventional methods mentioned above are applicable to a two-phase separation in which sludge is removed from liquid, but are not effective in a three-phase separation in which sludge, heavy liquid and light liquid are recovered. In a method in which such an electrical mechanism is eliminated (See, for example, Japanese Pat. Publication No. 19833/1973), liquid introduced into a pressure chamber to discharge the sludge itself contains some sludge, and therefore a nozzle used for removing the liquid from the pressure chamber is liable to become clogged.

SUMMARY OF THE INVENTION

The centrifugal separator according to this invention is especially effective where solid particules (sludge) and water drops floating in fuel oil (primary liquid) are to be separated, that is, the fuel oil is separated into three layers of sludge, water (heavy liquid) and clean oil (light liquid). This invention is also applicable, however, to the case where no water is contained in the fuel oil, that is, the fuel oil is separated into just sludge and clean oil.

Briefly, according to this invention, a centrifugal separator for fuel oil contaminated by water and sludge particles includes an inlet, nested separator plates, a clean oil outlet, a separated water outlet, and sludge outlets controlled by a valve cylinder closed by a first water pressure chamber and opened by a second water pressure chamber. When the sludge layer builds up and closes off a water discharge passage, the trapped water similarly builds up and overflows into a third chamber to force a piston downwardly. This opens a valve to allow water from a forth chamber to enter the second chamber and force the valve cylinder downwardly to open the sludge outlets. The water in the second and third chambers is slowly bled off through vent nozzles, whereby water in a fifth chamber enters the first chamber to raise the valve cylinder and close the sludge outlets. This water also enters a sixth chamber to raise the piston and close the valve.

BRIEF DESCRIPTION OF THE DRAWINGS

FIGS. 1, 2 and 3 illustrate the centrifugal separator during normal operation, immediately before sludge discharge, and during sludge discharge, respectively.

FIG. 4 shows the lower structure during normal operation, while

FIG. 5 shows the same lower structure during sludge discharge.

DETAILED DESCRIPTION OF THE PREFERRED EMBODIMENT

Figure 1:
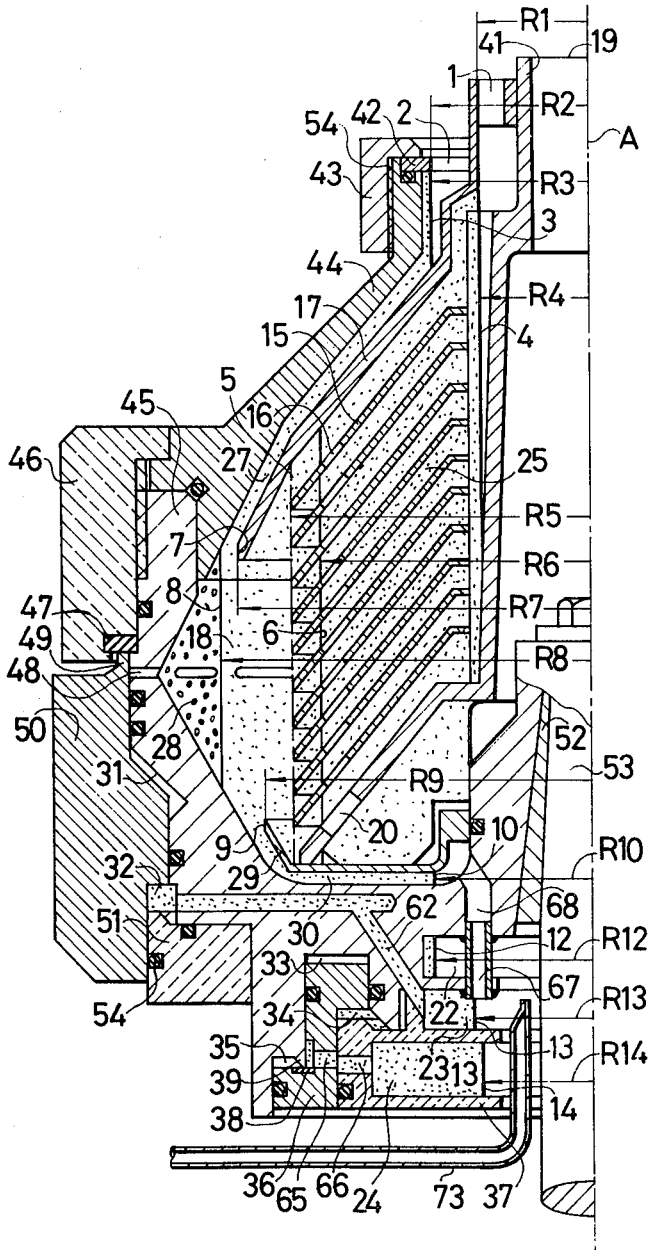
FIGS. 1, 2 and 3 show different sectional half-views of the same centrifugal separator according to an embodiment of this invention. For convenience of description, parts not arranged in the same sectional plane are shown in the figures by rotating the sectional planes around a common axis.
Figure 2:
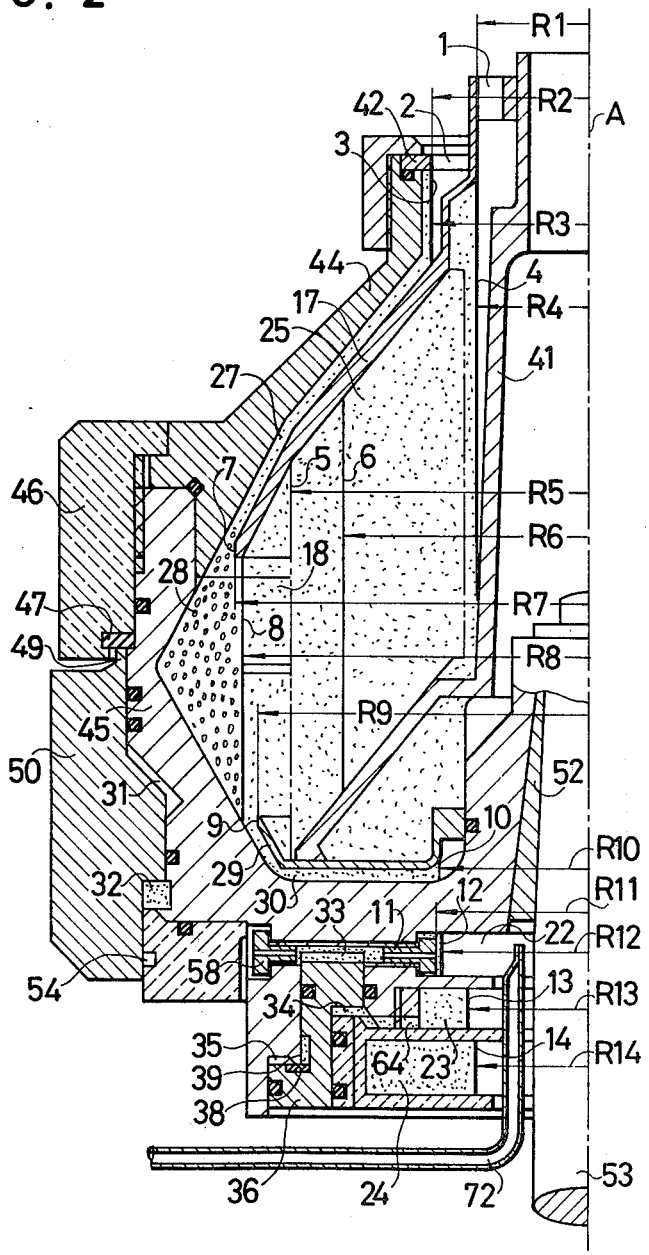
Figure 3:
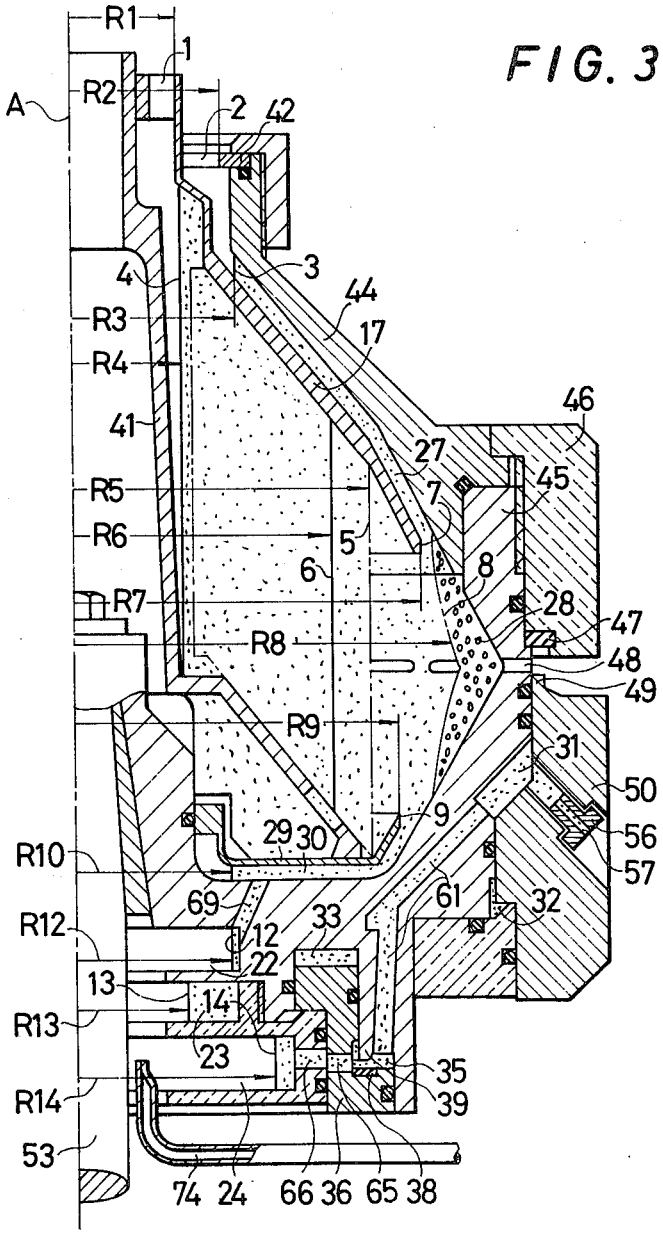

Referring to the drawings, FIGS. 1, 2 and 3 each show half of a vertical section of the rotary structure of a centrifugal separator according to this invention. While the sections shown in these figures include the same center axis of rotation A, they are taken along different vertical or radial planes and thus differ from one another slightly, particularly in their lower portions. FIGS. 1, 2 and 3 show the conditions of and within the rotary structure during normal operation, immediately before sludge discharge, and during sludge discharge, respectively.

FIGS. 2 and 3, only the outline of a group 25 of separating plates 15 is shown in broken line form, for the sake of simplicity.

The constructions and functions of a guide cylinder 41, a control plate 42, a control plate retaining nut 43, a rotary structure lid 44, a rotary shell 45, a rotary structure retaining nut 46, a valve packing 47, sludge discharge outlets 48, a valve flange 49, a valve cylinder 50, a rotary structure ring 51, a group 25 of separating plates 15, a water discharge plate 17, an upper water pressure chamber 31, a lower water pressure chamber 32, a drive shaft bushing 52, a drive shaft 53, and an O-ring seal 54 disposed in an annular groove are substantially the same as those of conventional automatic discharge centrifugal separators, except for the bottom portions of the rotary shell 45.

More specifically, the guide cylinder 41 is hollow, has an upper inlet 19 for incoming or primary liquid to be treated, and a plurality of primary liquid distributing ports 20 are concentrically arranged around its lower skirt. A plurality of thin separating plates 15 are nested or stacked in a spaced apart manner to form the group 25 of separating plates, and contain liquid passage ports 16 arranged over or above the primary liquid distributing ports 20. The separating plate group 25 is covered by the water discharge plate or baffle 17, which in turn is covered with the rotary structure lid 44 to define therebetween a heavy liquid discharge passage 27. The spaced passage 27 may further be defined by suitable projections or ribs, not shown. The rotary structure lid 44 is secured to the rotary shell 45 by the retaining nut 46. The valve cylinder 50 is vertically movable on the rotary shell 45 to define therebetween an annular upper water pressure chamber 31, while the rotary structure ring 51 is secured with bolts, not shown, to the rotary shell 45 to similarly form the annular lower water pressure chamber 32. The entire rotary structure is driven through the bushing 52 by the vertical drive shaft 53. The annual space outward from and surrounding the separating plate group 25 in the rotary shell 45 forms a sludge collection chamber 18, and a plurality of elongated sludge discharge outlets 48 are arranged at the point of maximum radius of the sludge chamber 18.

In accordance with the present invention, the rotary structure is additionally provided with a lower dish 29 and a vertically movable piston 36. The lower dish 29 is positioned between the rotary shell 45 and the separating plate group 25, and forms an annular heavy liquid chamber 30 with the bottom of the rotary shell 45. The piston 36 forms annular water pressure chambers 33, 34 and 35 in the rotary shell 45. Annular chambers 22, 23 and 24 are provided to supply water, as required, to the chambers 33, 34 and 35, the upper water pressure chamber 31, the lower water pressure chamber 32, and the heavy liquid chamber 30. A ring 37 is screwed into the rotary shell 45 to define the chambers 23 and 24.

Figure 4:
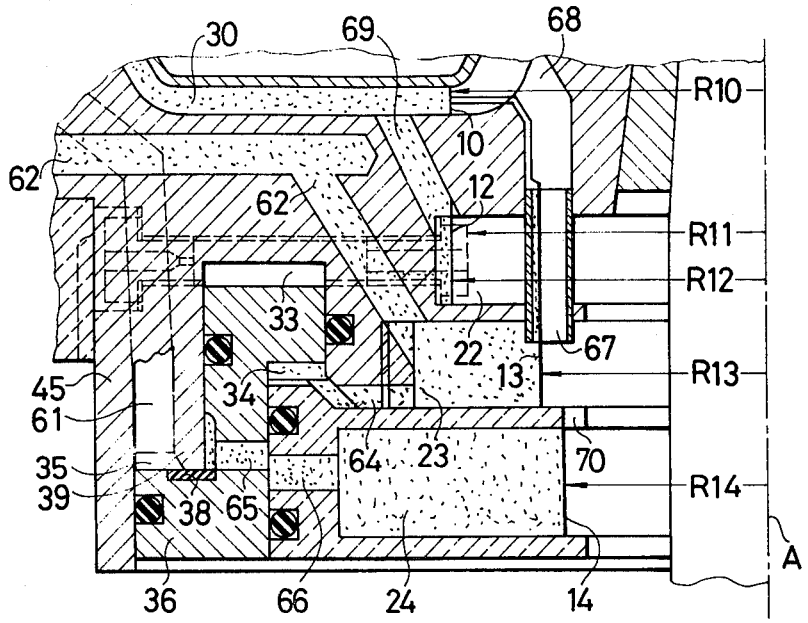
FIGS. 4 and 5 are enlarged part-sectional diagrams showing portions of the lower structure in FIGS. 1, 2 and 3, by suitably overlapping the sectional planes thereof in order to indicate the relative positions of the parts.
Figure 5:
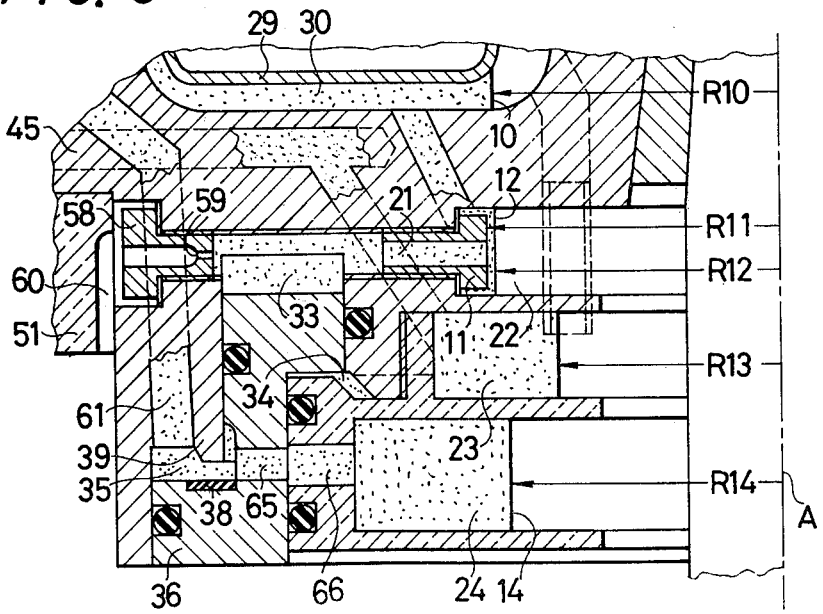

FIGS. 4 and 5 are enlarged sectional views showing the piston 36 and parts adjacent thereto. These figures are not completely accurate, and include intentionally overlapped sections to better illustrate the relative positions of the various parts. FIG. 4 shows the apparatus during normal operation, while FIG. 5 shows the apparatus at the time (slightly different from that in FIG. 3) of sludge discharge. In FIGS. 1 to 5, the sludge layer and the liquid are indicated by small cirles and dots, respectively.

It will be understood that although the drawings may show only single passages communicating the chambers 22, 23 and 24 with the water pressure chambers 33, 34, and 35, the upper chamber 31, the lower chamber 32, and the heavy liquid chamber 30, there are actually a plurality of evenly spaced such passages in order to maintain the balance and equilibrium of the rotary structure. Similarly, there is a plurality of water drainage nozzles 56 (FIG. 3) and 56 (FIG. 2) for discharging the water in chambers 31 and 33, respectively. These passages and nozzles will be further described below.

OPERATIONAL DESCRIPTION

The control plate 42 is so selected that the radius R2 of the heavy liquid outlet 2 is suitable for the concentration ratio of clean oil (light liquid) to water (heavy liquid) in the fuel oil (primary liquid) to be treated, and the control nozzles 11 (FIG. 2) are so selected that the distance R11 from the axis A is slightly (usually several millimeters) less than the distance R2. The control plate and the control nozzles thus selected are assembled to the rotary structure. After the centrifugal separator has been appropriately drained and cleaned as required, rotation is initiated with the structure empty. When the rotational speed reaches a certain value, water is jetted into the chamber 23 through a water supply pipe 73 (FIG. 1), and from there flows into the lower water pressure chamber 32. Accordingly, the chamber 32 and its communicating passage 62 become filled with water, and the high water pressure created by centrifugal force raises the valve cylinder 50. As a result, the valve flange 49 becomes tightly seated against the valve packing 47, whereby the sludge discharge outlets 48 are closed. The water in chamber 23 also flows through a passage 64 (FIG. 2) into chamber 34, and the piston 36 is pushed upward by the resulting water pressure. The annular packing 38 (FIG. 4) is thus seated against the annular projection 39. Thereafter, the water jetted into chamber 23 builds up and eventually flows into the sludge chamber 18 through the passages 67, 68 and the heavy liquid chamber 30, and is stored therein, whereby the radius R13 of the water surface becomes constant. The surfaces of the accumulated or stored water are substantially cylindrical due to the strong centrifugal force.

When the radius of the cylindrical surface of the water in chamber 18 becomes less than the radius R7 of the water discharge plate outer edge 7, the passage of light liquid or oil through the heavy liquid discharge passage 27 is blocked. The water in chamber 18 may thus be called blocking water. After the quantity of blocking water has reached a predetermined level or value, which can be estimated from the total quantity of water supplied through the pipe 73, the latter can be closed or the flow rate therethrough reduced. Thereafter, primary liquid is supplied to the inlet 19 located at the upper part of the guide cylinder 41, and flows down inside the guide cylinder 41 and enters the separating plate group 25 through the ports 20 and 16. In the separating plate group, the primary liquid is subjected to strong centrifugal separation, as a result of which light liquid or oil is forced inwardly and discharged out of the structure through the light liquit outlet 1 at the top of the water discharge plate 17. The separated heavy liquid or water is mixed with the blocking water and discharged through the passage 27 and the outlet 2 in the control plate 42.

The separated sludge is deposited in the chamber 18 to form a fluidic sludge layer 28. The interface between the layer 28 and the heavy liquid becomes cylindrical, and its radius R8 decreases with increased sludge separation and deposition. If a relatively small amount of water is jetted through the water supply pipe 74, FIG. 3, either before or after the primary liquid is supplied, the chamber 24 and its associated passages 66 and 65 become filled with water, but it cannot flow into the chamber 35 because the projection 39 is seated against the packing 38, and the excess water thus flows into the chamber 23 through a hole 70, best seen in FIG. 4.

The radii of the free surfaces of the heavy liquid and the light liquid and the radius of the interface between the heavy liquid and the light liquid will now be discussed. Under normal conditions the radius R4 of the free surface 4 of the light liquid is slightly smaller than the radius R1 of the light liquid outlet 1. The free surface of the heavy liquid appears at three positions. One, designated by reference numeral 3, is located near the control plate 42, and its radius R3 is slightly smaller than the radius R2 of the heavy liquid outlet 2. Another free surface 10 of the heavy liquid is located in the chamber 30, and its radius R10 is also slightly smaller than the radius R3. The last free surface 12 of the heavy liquid is located in the chamber 22, and the radius thereof is equal to the radius R10 owing to the open communicating passage 69. The interface 6 between the light liquid and the heavy liquid in the separating plate group 25 is not distinctive; however, its equivalent radius R6 is somewhat less than the radius R5 of the separating plate outer edge 5.

The term "normal conditions" as used herein applies when the radius of a free surface obtained when a predetermined quantity of blocking water is injected into the rotary structure is less than the radius R7 and the radius R9 of the lower dish outer edge 9, i.e., is substantially equal to the radius R6, and the radius R8 of the sludge layer is greater than the radius R7. Under such normal conditions, the heavy liquid and the clean water flow in the passage 27 and the chamber 30, respectively; however, since the resistance to these flows is extremely small and the density or specific gravity of the heavy liquid is almost the same as that of the clean water, the radius R3 is almost the same as the radius R10, and furthermore since the chambers 30 and communicate with each other through the passage 69 (FIG. 4), the radius R10 becomes equal to the radius 12. Accordingly, the radius R12 is approximately equal to the radius R3, and the radius R3 is slightly smaller than the radius R2. On the other hand, as the radius R11 is smaller by several millimeters than the radius R2, the radius R11 is slightly smaller than the radius R12.

If the operation is continued under normal conditions, as the quantity of sludge increases the radius R8 is reduced; that is, the radius R8 reaches and finally becomes less than the radius R7 (see FIG. 2). As this happens, the outer edge 7 of the water discharge plate gradually sinks into the sludge layer 28, thus giving great resistance to the entry of heavy liquid (water) into the passage 27. As the heavy liquid encounters this resistance, its pressure in the sludge chamber 18 increases, and the radius R6 of the interface 6 between the light liquid and the heavy liquid decreases. With this decrease, the radii R10 and R12 are also gradually decreased. If the radius R12 becomes less than the radius R11, then the water in the chamber 22 flows into the water pressure chamber 33 through the passage 21, FIG. 5, of the control nozzle 11.

Overlapped FIG. 4 shows the apparatus under normal conditions, where the radius R12 is greater than the radius R11. Overlapped FIG. 5 illustrates the apparatus when the sludge quantity is sufficient for discharge. Although the presence of the liquid in these figures is indicated by dots, the dots are not solid particles contained in the liquid. In FIGS. 2 and 5, as the water in chamber 22 flows into chamber 33 through passage 21 in the control nozzle 11, such was is replenished through the passage 69 from the chamber 30. The water in the annular chamber 33 is slowly discharged out of the rotary structure through the small hole 59 of the drainage nozzle 58 and the groove 60, and thus a quantity of water corresponding to the difference between the flow-in and flow-out quantities is stored in the chamber 33. When chamber 33 becomes filled with water, the force urging piston 36 downward becomes greater than the force urging it upward due to the water pressure in chamber 34, owing to the different effective areas of the two chambers. As a result the piston 36 is moved downwardly, a gap is created between the packing 38 of the piston and the projection 39, and the clean water stored in the chamber 24 flows into the chamber 35 through the communicating passages 66 and 65. The water pressure thus generated in chamber 35 provides a further downward force on the piston 36.

The water in chamber 35 flows into the upper water pressure chamber 31 through passage 61, FIG. 3. Since the clean water in chamber 31 is slowly discharged out of the rotary structure through the small hole 57 in the drainage nozzle 56, a quantity of water corresponding to the difference between the imcoming and outgoing flow rates accumulates in the chamber 31. When the chamber 31, passage 61, and chamber 35 become filled with water, the force acting to depress or open the valve cylinder 50 becomes greater than the closing force of 32, owing to the different effective areas of the two chambers, and the valve cylinder is moved downwardly. As this happens, the internal volume or capacity of chamber 31 increases, and a large quantity of clean water is fed into the chamber. As a result, the quantity of the water in chamber 24 decreases and the radius R14 is increased, FIG. 3.

If the flow rate of clean water jetted into the chamber 24 from the water supply pipe 74 is low enough to be disregarded when compared with the flow rate of water out of the drainage nozzle 56, when the valve cylinder 50 is moved downward the water left in the chamber 24 is used to replace the water flowing out of nozzle 56. Chamber 24 is emptied in a short period of time, however, and following this the water in the passages 66 and 65 and chamber 35 is successively emptied or drained. This decreases the pressure in the chamber 31, which in turn decreases the force urging the valve cylinder 50 downwardly, and this force finally becomes less than the force urging the valve cylinder upwardly from the lower water pressure chamber 32. Thereafter, the valve cylinder 50 is moved upward in proportion to the quantity of water escaping out of the drainage nozzle 56.

Accordingly, in order to provide a suitable sludge discharge time, that is, the time from the instant when the downward movement of the valve cylinder commences to the time when its upward movement is completed, the dimensions of each part must be appropriately selected. If the rotary structure is so designed that the number of water drainage nozzles 56, the size of the holes 57, and the effective capacity of the chamber 24 can be readily changed or varied, then it is a simple matter to change or adjust the sludge discharge time. As there is a space between the valve flange 49 and the valve packing 47 when the valve cylinder 50 is moved to its downward position, the sludge is centrifugally discharged through such space from the sludge discharge outlets 48. As the sludge is discharged, the radius R8 is gradually increased and finally becomes greater then the radius R7. If the radius R8 becomes excessively large the heavy liquid, or at worst the primary liquid, in addition to the sludge is discharged. Therefore, the sludge discharge period must be set so that when a suitable amount of sludge, but less than all of it, is discharged the valve cylinder is moved upward to close the discharge space.

The variation of the quantity of water in the chamber 33 will be described. The flow rate of the water supplied to chamber 33 through the passage 21 of the control nozzle 11 in the chamber 22 from the chamber 30 decreases as the sludge discharge begins, and the radius R12 increases, and this flow rate becomes zero when the radius R12 becomes greater than the radius R11. On the other hand, the water in chamber 33 continuously escapes through the drainage nozzle 58. Therefore, it will be impossible to maintain the piston 36 in its downward position only by the water pressure of chamber 33 soon after the sludge discharge has begun. However, it is difficult to determine just when the pressure in chamber 33 will drop below the critical level. Accordingly, if the rotary structure is so designed that the piston 36, once moved downward, maintains its position only by the water pressure in chamber 35, the sludge discharge period can be more accurately set. In this regard, when the chamber 35 is substantially emptied and the valve cylinder 50 is moved upward, if the chamber 33 is also empty the piston 36 will be moved upward. If, however, there is a large quantity of water left in the chamber 33, the piston 36 will remain in its downward position until the water in the chamber has flowed out. The clean water jetted into the chamber 24 from the water supply pipe 74 during this period is discharged through the water drainage nozzle 56, and therefore no water is stored in the chamber 24. However, since there is ample time before the next sludge discharge is conducted, the piston 36 may be raised considerably later than the valve cylinder 50, and therefore the size of the hole 59 is not particularly critical. In the first fully automatic sludge discharge after the centrifugal separator has been started, only part of the sludge in the layer 28 is discharged. Accordingly, the next sludge discharged cycle is started earlier, and thereafter the sludge discharges are effected at substantially equal time intervals. In actual practice, of course, the discharges are not always conducted at equal time intervals because of variations in the sludge content of the primary liquid.

To stop the operation of the centrifugal separator, it is preferable that the rotation be stopped only after all the sludge, heavy liquid, and light liquid have been discharged, as with conventional centrifugal separators. To stop the centrifugal separator of the invention, the supply of the primary liquid is first suspended. Next, the flow rate of the water jetted into the chamber 23 from the pipe 73 is increased to a suitable value. The radius R6 of the interface 6 between the heavy liquid and the light liquid decreases as water is introduced into the sludge chamber 18 from the chamber 23, and the recovery of the light liquid is continued until no more remains. Then, a large quantity of clean water is jetted into the chamber 22 from the pipe 72 in a short period of time. As a result, the radius R12 of the water surface in chamber 22 becomes smaller than the radius R11, and a sludge discharge cycle occurs as described above. After the sludge discharge the water supply pipe 72 is turned off, and after the radius R14 in chamber 24 is restored, a large quantity of clean water is again jetted from pipe 72 to carry out another sludge discharge. When approximately all of the sludge has been discharged in this way, a final flushing is conducted by opening the water supply pipe 72 and simultaneously jetting a large quantity of clean water into the chamber 24 from the water supply pipe 73, or from a larger water supply pipe provided especially for this purpose. In this case, since the valve cylinder 50 remains open for a relatively long period of time, the rotary structure is completely emptied and cleaned. When it is required toempty the rotary structure in a shorter period of time, the supply of primary liquid is stopped, the flow rate of water supplied to the chamber 24 is increased to a considerably large value, and then a larger amount of clean water is momentarily jetted into the chamber 22 from the water supply pipe 72. The cleaning operation carried out after the rotary structure has been emptied is the same as that for conventional centrifugal separators.

If the flow rate of water (heavy liquid) separated from the fuel oil (the primary liquid) and discharged through the passage 27 is sufficient that the radius R12 in chamber 22 can be made smaller than the radius R11 when the water discharge plate outer edge 7 has been sunken into the sludge layer 28, the water supply pipe 73 may be turned off after a specified quantity of blocking water has been fed, whereby clean water can be saved. Although the leakage stopping O-ring is provided, it is still necessary to supplement the water leaking from the chambers 32 and 34. However, usually this supplement can be achieved with the water which flows into the chamber 23 through the hole 70 from the chamber 24. When the content of water contained in the fuel oil is considerably low and the flow rate of the heavy liquid through the passage 27 is thus insufficient, the clean water jetted into the chamber 23 from the pipe 73 flows into the sludge chamber 18 through the passage 67 and the chamber 30, and mixes with the heavy liquid, which supplements the heavy liquid running through passage 27. With ordinary fuel oil, the time interval T1 for sludge discharge is two to four hours, and therefore it is unnecessary to jet water from the pipe 73 in order to supplement the shortage of heavy liquid until a certain period of time T2 (1.5 hours for instance) after the last sludge discharge. Furthermore, since the radius R8 of the sludge level immediately before sludge discharge may be somewhat varied, the above-described supplement can be effected merely by intermittently jetting water from the pipe 73 for a short period of time. By minimizing the sum of the periods of water jetting time, the consumption of clean water can be minimized. Thus, the centrifugal separator of this invention can be operated economically even where little or no water is contained in the fuel oil.

The lower dish 29 serves to communicate the heavy liquid held at the level of the radius R9 with the liquid in the chambers 22 or 23. If this communication is effected by providing a passage or pipe instead of the chamber 30, then the lower dish 29 can be omitted. The radius R9 must be smaller than the radius R7, and preferably larger than the radius R5. Where the flow rate of the heavy liquid is low, the cross-sectional area of the passage 27 may be made smaller at the location of the outer edge 7. To obtain sufficient force to raise the piston 36, a spring may be employed in place of the pressure chamber 34.

The primary liquid to be treated by the centrifugal separator of this invention is not limited to fuel oil, but may be mineral oil, animal oil, vegetable oil, or any other liquid capable of being separated into three layers. If the heavy liquid is not water, then a liquid which is comparable in quality to the heavy liquid and which is free from solid matter is supplied to the pipes 72, 73 and 74 instead of water.

What is claimed is:

1. In an automatic, three stage, sludge discharging centrifugal separator for separating a primary liquid into sludge, heavy liquid and light liquid components, and including a primary liquid inlet (19), a plurality of nested separator plates (15), a light liquid outlet (1), a heavy liquid outlet (2), sludge outlet means (48), generally cylindrical casing means (44, 45) surrounding and defining said inlet and outlets, a valve cylinder (50) slidable on said casing means between a raised position at which said sludge outlet means are closed and a lowered position at which said sludge outlet means not open, a first expandable pressure chamber (32) for raising said valve cylinder, a second expandable pressure chamber (31) for lowering said valve cylinder, means (17) defining a heavy liquid discharge passage (27) between said casing means and said separator plates, and drive means (52, 53) for rotating all of the above structure, the improvements characterized by:

a. a first reservoir (24) for heavy liquid, b. first passage means (66, 65, 35, 61) communicating between said reservoir and said second pressure chamber, c. piston means (36) slidably mounted in said casing means and including valve means (38, 39) controlling said first passage means, d. a heavy liquid level sensing chamber (30), e. a first operating chamber (33) for said piston means, and f. overflow passage means (69, 22, 21) communicating between said sensing chamber and said first operating chamber, whereby when the sludge accumulates in the casing means to a predetermined level it blocks the heavy liquid discharge passage, the heavy liquid level builds up in the sensing chamber and flows through the overflow passage means into the first operating chamber, the piston means is moved to open the valve means, heavy liquid flows from the first reservoir into the second pressure chamber, the valve cylinder is lowered, and the sludge outlet means are opened.

2. A centrifugal separator as defined in claim 1 further comprising a second reservoir (23) for heavy liquid, second passage means (62) communicating between said second reservoir and said first pressure chamber, and open bleed nozzle means (57, 59) for slowly draining liquid from said second pressure chamber and first operating chamber, respectively, and wherein the operative area of said second pressure chamber is greater than that of said first pressure chamber, whereby the heavy liquid is slowly drained from said second pressure chamber after the valve cylinder is lowered thereby until the force exerted by said first pressure chamber, due to heavy liquid therein from said second reservoir via said second passage means, exceeds that exerted by said second pressure chamber, and the valve cylinder is raised to close the sludge outlet means.

3. A centrifugal separator as defined in claim 2 further comprising a second operating chamber (34) for said piston means communicating with said second reservoir, and wherein the operative area of said first operating chamber is greater than that of said second operating chamber, whereby the heavy liquid is slowly drained from said first operating chamber after the piston means is moved to open the valve means until the force exerted by said second operating chamber exceeds that exerted by said first operating chamber, and the piston means is moved to close the valve means.

4. A centrifugal separator as defined in claim 1 further comprising means for supplying desired quantities of heavy liquid to said casing means.

5. A centrifugal separator as defined in claim 2 further comprising means for supplying desired quantities of heavy liquid to said casing means.

6. A centrifugal separator as defined in claim 3 further comprising means for supplying desired quantities of heavy liquid to said casing means.

7. A centrifugal separator as defined in claim 1 wherein the structure recited in sub-paragraphs a) through f), inclusive, is mounted in a lower portion of said casing means (45),

8. A centrifugal separator as defined in claim 2 wherein the structure recited in sub-paragraphs a) through f), inclusive, of claim 1 and the structure recited in claim 2 is mounted in a lower portion of said casing means (45).

9. A centrifugal separator as defined in claim 3 wherein the structure recited in sub-paragraphs a) through f), inclusive, of claim 1 and the structure recited in claims 2 and 3 is mounted in a lower portion of said casing means (45).

* * * * *